US006230468B1

(12) United States Patent
Klaus

(10) Patent No.: US 6,230,468 B1
(45) Date of Patent: May 15, 2001

(54) FOUNDATION WATERPROOFING SYSTEM

(76) Inventor: Hal Klaus, 70 Trout Dr., Highland, IL (US) 62249

( * ) Notice: Subject to any disclaimer, the term of this patent is extended or adjusted under 35 U.S.C. 154(b) by 0 days.

(21) Appl. No.: 09/496,393

(22) Filed: Feb. 2, 2000

(51) Int. Cl.[7] ..... E04G 23/02

(52) U.S. Cl. ..... 52/741.11; 52/169.5; 52/169.14; 52/287.1; 52/302.3; 52/741.4; 52/741.13; 405/39

(58) Field of Search ..... 52/169.5, 169.13, 52/169.14, 287.1, 302.3, 302.1, 741.11, 742.1, 741.13, 741.4; 405/36, 39, 43, 45, 229

(56) References Cited

U.S. PATENT DOCUMENTS

| | | | | |
|---|---|---|---|---|
| 3,852,925 | | 12/1974 | Gazzo . | |
| 3,975,467 | | 8/1976 | Beck . | |
| 4,265,064 | | 5/1981 | Parezo . | |
| 4,333,281 | | 6/1982 | Scarfone . | |
| 4,486,986 | | 12/1984 | Cosenza . | |
| 4,590,722 | | 5/1986 | Bevelacqua . | |
| 4,757,651 | | 7/1988 | Crites . | |
| 5,035,095 | | 7/1991 | Bevilacqua . | |
| 5,495,696 | * | 3/1996 | Repka | 52/169.5 |
| 5,501,044 | * | 3/1996 | Janesky | 52/169.5 |
| 5,551,797 | | 9/1996 | Sanford . | |
| 5,660,008 | | 8/1997 | Bevilacqua . | |
| 5,765,323 | * | 6/1998 | Bevilazqua | 52/169.5 |
| 5,794,388 | * | 8/1998 | Jackman | 52/169.5 |
| 5,836,115 | * | 11/1998 | Clay et al. | 52/169.5 |
| 5,845,456 | * | 12/1998 | Read | 52/741.11 |
| 5,931,603 | * | 8/1999 | Swain et al. | 405/229 |

* cited by examiner

*Primary Examiner*—Carl D. Friedman
*Assistant Examiner*—Yvonne M. Horton
(74) *Attorney, Agent, or Firm*—Greensfelder, Hemker & Gale, P.C.

(57) ABSTRACT

A method is provided for waterproofing a foundation in which a minimal amount of debris is generated. The method provides for selecting a first limited area of excavation of a floor along a wall. A tunnel is dug laterally below the floor to a location remote from the area of excavation for receiving a drainage pipe underneath the floor. A narrow channel is further excavated within the floor along the wall for receiving accumulated moisture leaking in from the wall. The channel directs and drains the moisture towards the excavated area in the floor and the drainage tunnel. With the limited amount of excavation provided by this method, the amount of concrete to be removed is substantially reduced.

30 Claims, 15 Drawing Sheets

FOUNDATION WATERPROOFING SYSTEM

BACKGROUND OF THE INVENTION

The invention addresses problems relating to seepage of water into buildings along walls and flooring, especially in basements. It has always been a problem in keeping water from leaking into basements or other rooms that are at or below ground level. Cracks frequently generate in the walls, which allow moisture to trickle in from the outside. Further, water can enter from the outside around the area at the juncture between the wall and footing. The moisture accumulates and results in puddles of water on the floor inside the building. There exist many systems that effectively address this problem, such as by providing means for collecting the moisture that seeps in along the walls, usually in the form of a perimeter channel excavated along the wall, and directing that collected moisture to a drainage pipe installed beneath the floor. These methods are commonly referred to as waterproofing a basement.

While these types of waterproofing methods are often effective, they are extremely labor intensive and produce a tremendous amount of debris from broken concrete and excavated dirt. This presents serious concerns from both economic and environmental standpoints. It is becomingly increasingly difficult to find affordable labor, much less willing labor, to carry out these methods given the physically demanding work required for excavating and installing such systems. This drives up the cost of these waterproofing systems. Additionally, the debris created from excavation must be transported to appropriate landfill sites. Such sites are typically located substantially remote from the job site, and frequent truckloads are generally required to haul off the debris, which is time consuming and expensive. This further drives up the cost of these systems.

Another problem to be dealt with when considering excavating for installing the drainage pipe used in these waterproofing systems relates to forces placed on the foundation wall. Damp expansive soil experts tremendous lateral pressure against the outside surface of the foundation wall, often resulting in a bowed-in wall. The intact contact floor acts as a barrier, which meets and opposes the pressure forces of the soil and keeps the wall from bowing in at its base. When a drainage pipe is installed, a substantial amount of the concrete floor is removed so that the drainage pipe may be laid down. Therefore, the barrier effect of the floor is compromised. While a thin layer of concrete is typically poured back in the floor after installation, it is usually insufficient to provide the desired resistance to the lateral stress from the outside soil. A further concern is that with the large opening in the floor for laying down the drainage pipe, the exposed ground soil has increased potential for releasing harmful Radon gas.

It would therefore be desirable to provide an effective method for waterproofing a foundation, wall or other structure that minimizes the debris created by, and labor involved in, excavating and installing a drainage pipe below the surface of the floor alongside the footing.

Further, it would be beneficial to provide a waterproofing method that preserves the structural integrity of the floor so that its ability to withstand the lateral stress placed by the outside soil on the foundation wall is not impaired. Further still, it would be beneficial to provide a waterproofing system that would minimize the amount of floor resulting in less labor to be excavated.

SUMMARY OF THE INVENTION

By means of the instant invention there is provided a method for waterproofing a foundation, wall or other structure in which a minimal amount of concrete debris is generated and which minimizes the disruption to the structural integrity of the floor. The object of the method of this invention is to minimize the amount of excavation of the concrete floor itself necessary for installing the drainage pipe beneath the floor, thus limiting the generation of a large quantity of concrete debris. The method provides for first excavating at a localized area on the floor adjacent to a wall to a sufficient depth below the floor to accommodate the full diameter of the pipe in a lateral orientation underneath the floor. A tunnel is then excavated laterally underneath the floor to a length sufficient to accommodate the length of the drainage pipe that is to be installed. In most instances, the tunnel will lie parallel with the wall; however, the tunnel may also be directed in other orientations depending on the drainage field desired. By laterally excavating the tunnel from underneath the floor, rather than from above the floor, large debris comprising concrete chunks is minimized. Instead, relatively loose dirt is generated, which is much easier to manage. While excavating the under-floor tunnel, a flexible drainage pipe may be strung behind the excavation mechanism so the pipe may be installed simultaneously with drilling. A second remote area may be excavated through the floor adjacent the wall to connect with the termination point of the drainage pipe tunnel.

A channel is cut or chipped into the floor for collecting seeping moisture along the wall. The channel need only be a few inches from the wall, creating just enough of a width for water to be channeled therein. It is not necessary to also extend the channel down through or to, the footing, as the channel can exist on top of it, yet still be below the top surface of the floor. The depth of the floor need not be completely removed to create the channel, and it is preferable to leave a bottom portion of the thickness of the floor intact to serve as a support against the lateral force exerted on the wall by the outside soil. The span length of the channel is disposed so that it extends to the open excavation area which is in fluid communication with the tunnel and the drainage pipe. The channel is extended to communicate with any second or subsequent excavation areas. Weep holes may be drilled into the wall at or near the bottom of the channel to facilitate the draining of moisture into the channel from the wall's cavity. The channel and the excavation areas may be sealed off at the top, above the weep holes, to create a closed drainage system.

The concrete debris generated from the excavation method is therefore relatively minimal and can be used to support the drainage pipe within the tunnel. This method thus greatly reduces the labor involved in the excavation and installation of drainage pipes for waterproofing a foundation or other wall and floor structure. Further, it minimizes the disruption to the floor itself by limiting the amount of excavation required for the drainage pipe.

DESCRIPTION OF THE INVENTION

Figure 1:
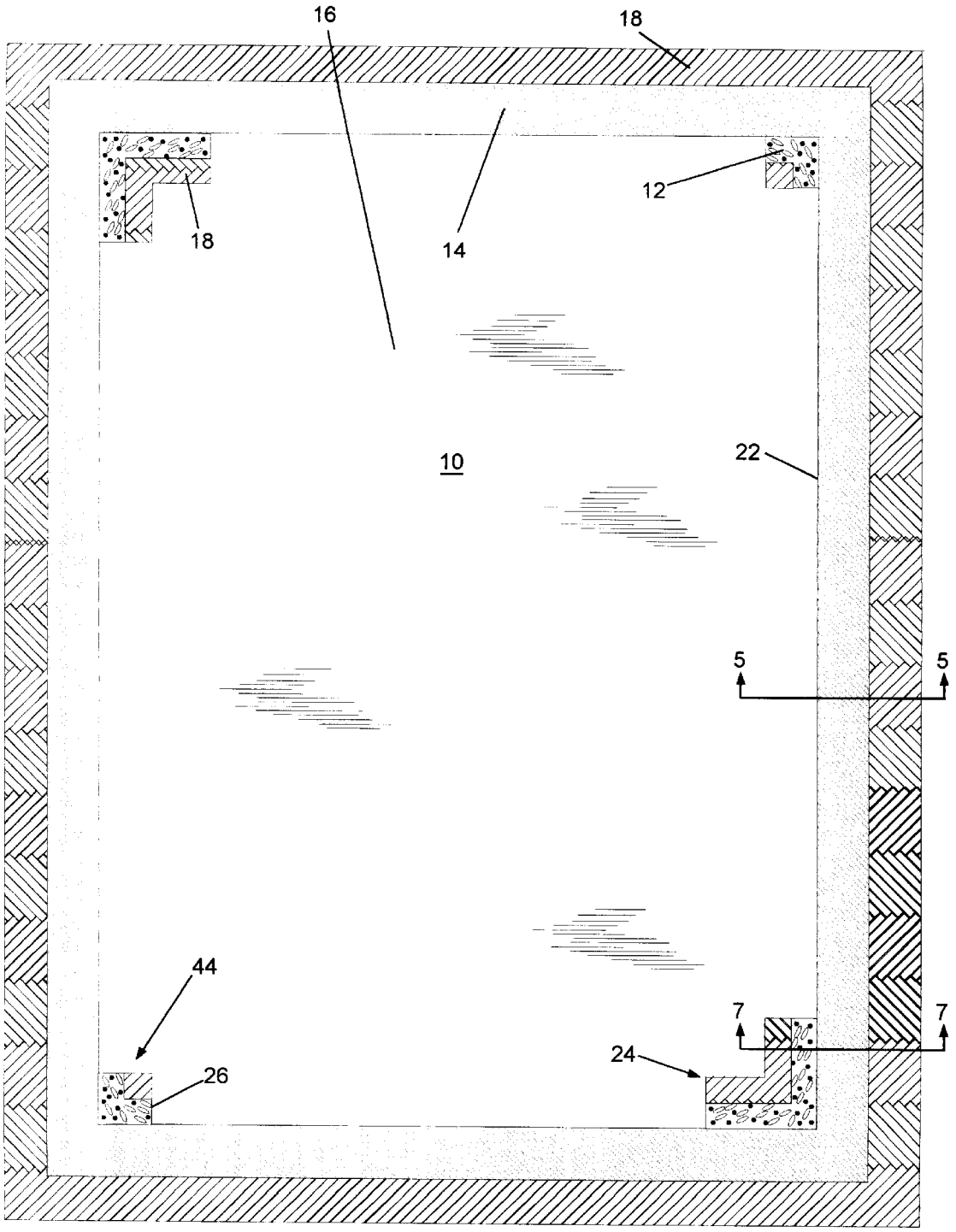
FIG. 1 is a cross-sectional top plan view of the floor, showing the excavation areas created for the practice of this invention.
Figure 5:
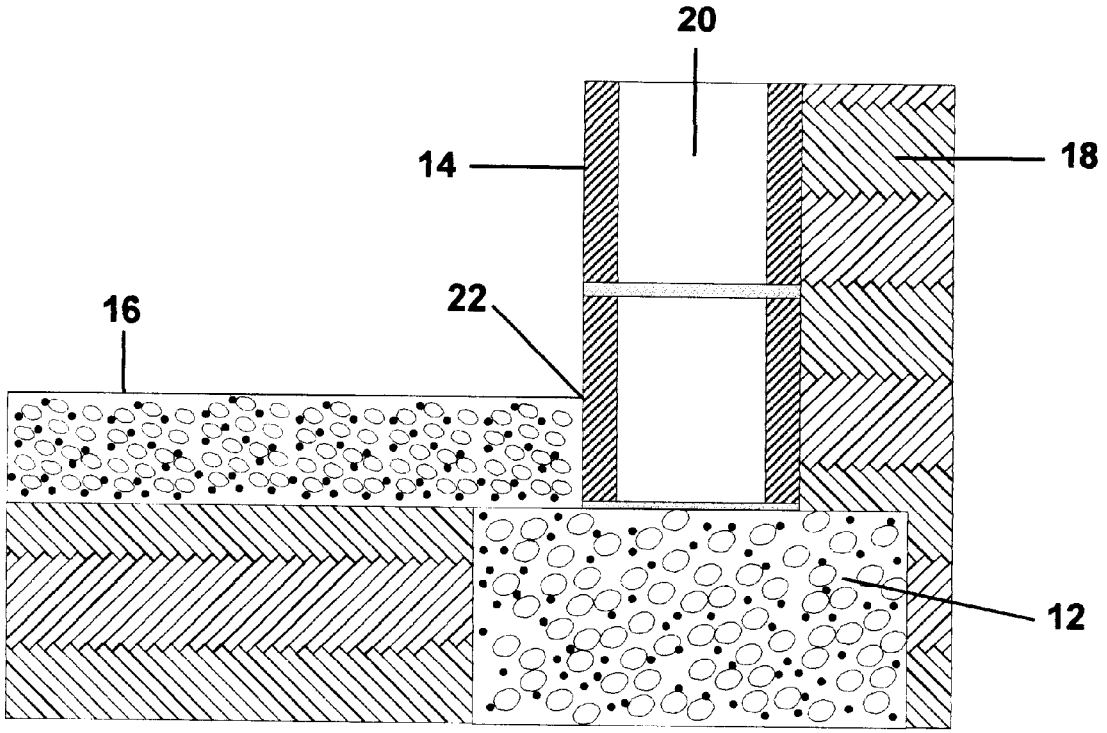
FIG. 5 is a cross-sectional view in side elevation of a wall, floor and footing, taken along lines 5—5 of FIG. 1 where the wall is of the type having a hollow inner chamber.
Figure 6:
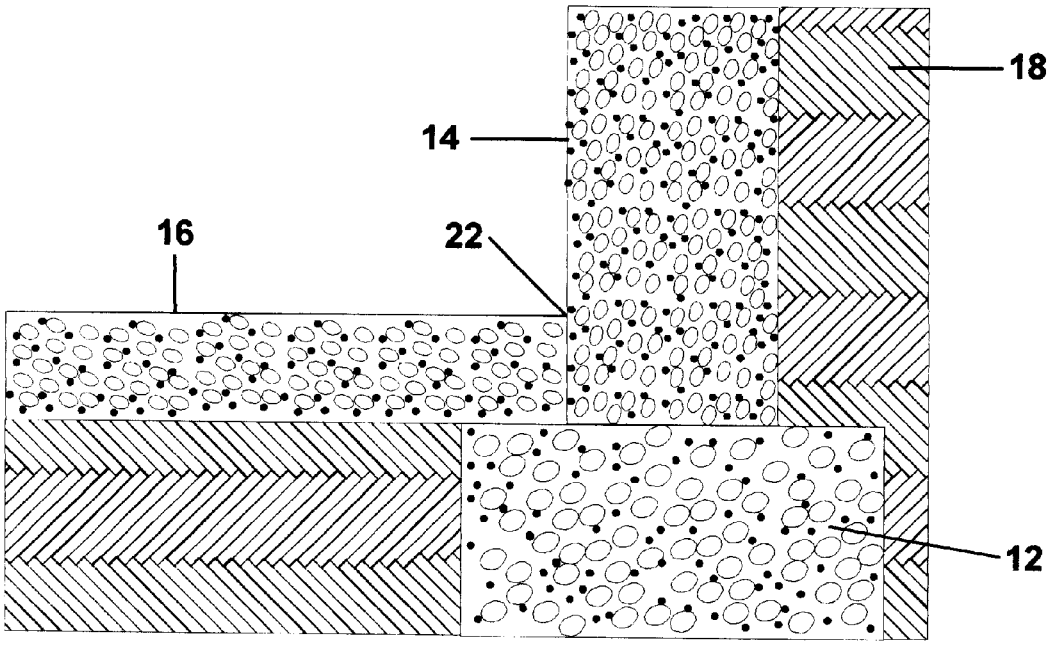
FIG. 6 is a view similar to FIG. 5, where the wall is solid.

FIG. 1 shows a foundation, wall and floor arrangement, generally designated by the reference numeral 10, to which the waterproofing system of the instant invention is directed. It comprises a footing 12 upon which a wall 14 is supported, from which a floor 16 extends laterally. Ground soil 18 lies exteriorly of wall 14 and beneath footing 12. While the invention is directed towards waterproofing the entire structure comprising the four walls and floor shown by FIG. 1, it is to be understood that discrete spans of the walls and floor may only be treated as the particular situation dictates. For instance, perhaps only one section of the wall in a room faces the exterior of the building, while the rest of the wall sections adjoin other interior walls of adjacent rooms. Wall 14 may comprise a solid structure as shown in FIG. 6, or may be hollow as shown in FIG. 5 in which an inner chamber 20 is formed. Moisture generally seeps into the structure through cracks (not shown) in wall 14, and runs down the sides towards the floor. Further, water can enter from the outside around the area at the juncture between the wall and footing. It is typically the juncture 22 of the floor and wall that presents the opportunity for capture and redirection of the accumulated moisture.

Figure 2:
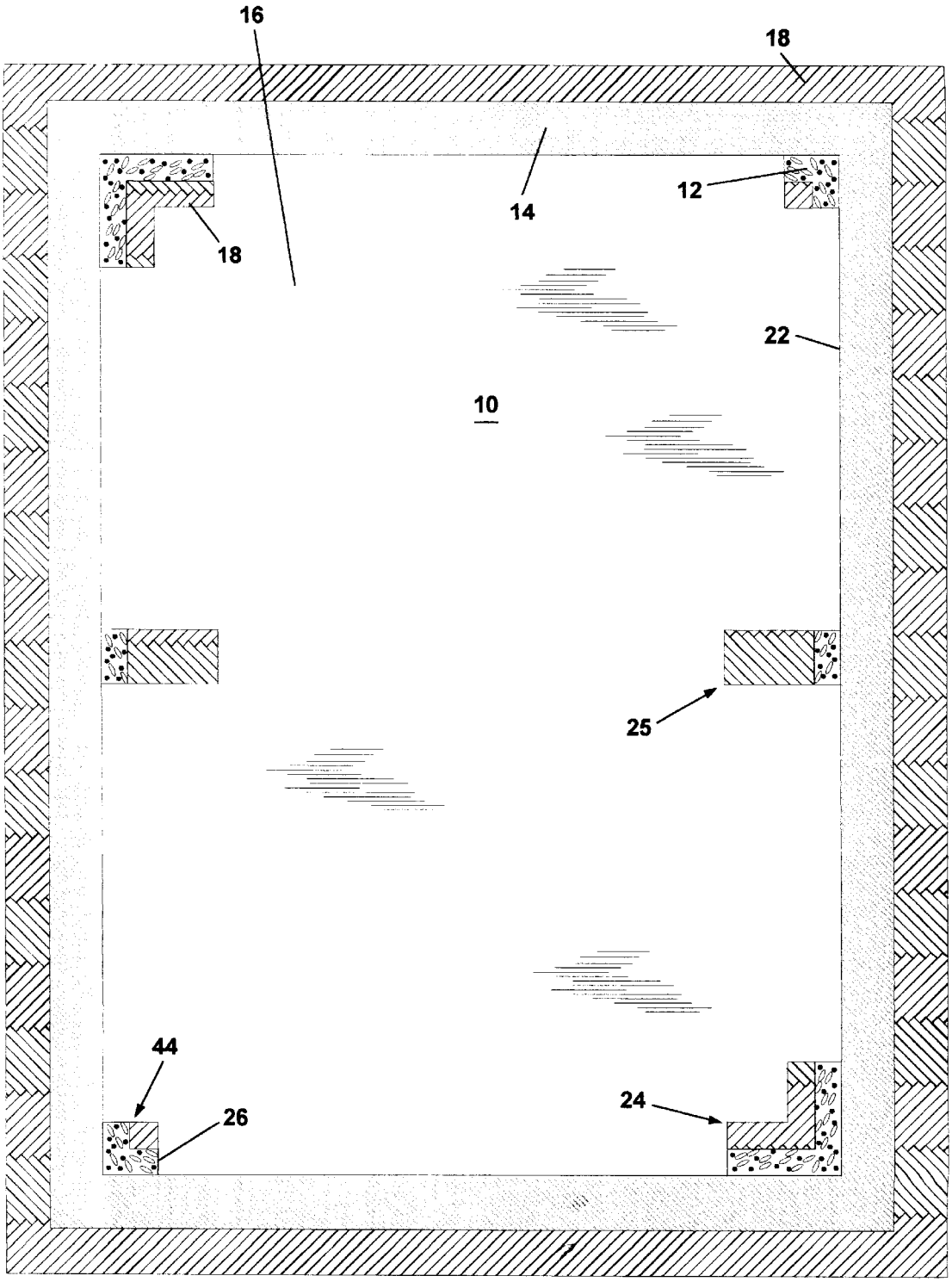
FIG. 2 is another cross-sectional top plan view of the floor, showing alternate excavation areas.
Figure 4:
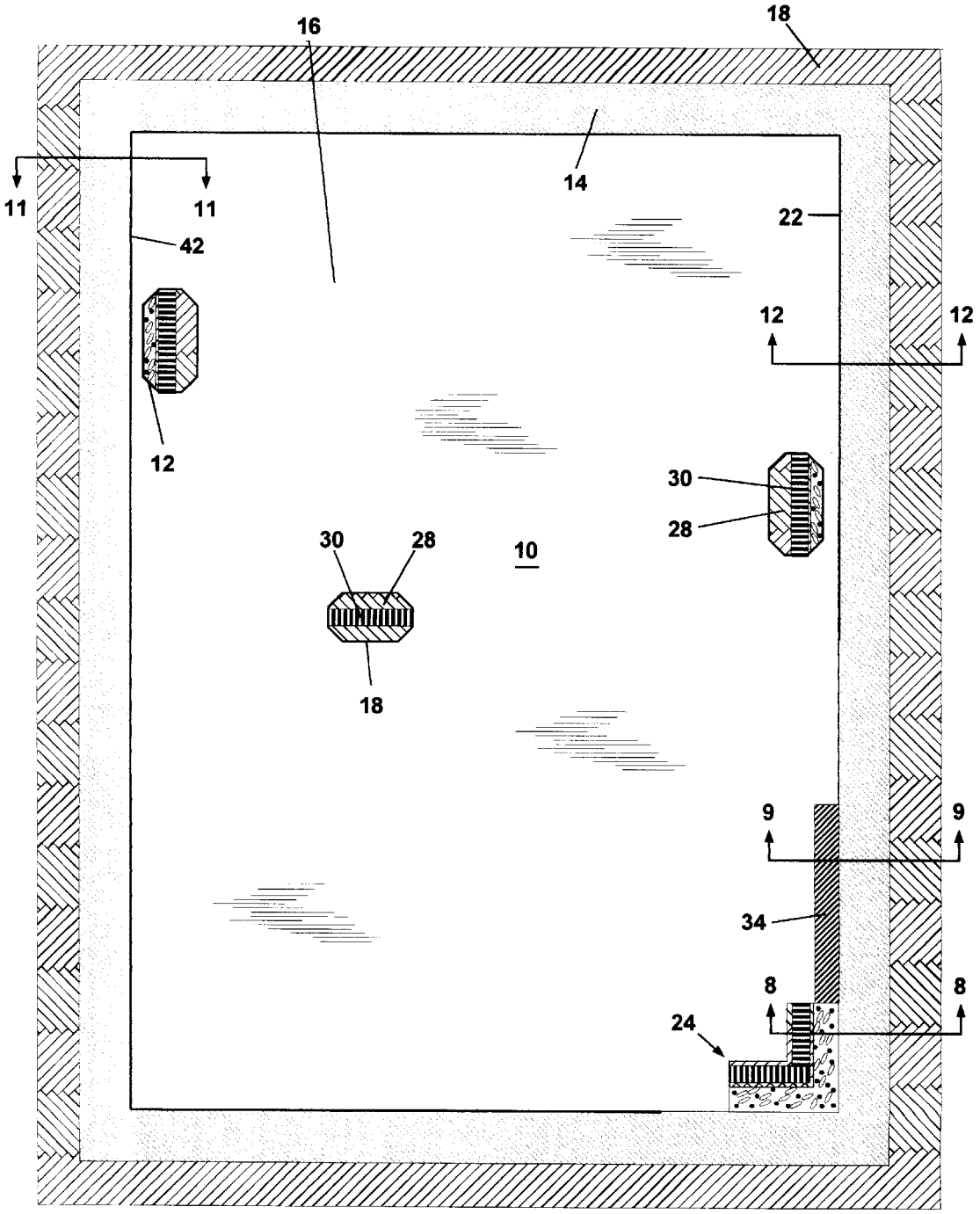
FIG. 4 is a cross-sectional top plan view of the floor, showing the excavation areas, the channel, an alternate layout of the drainage tunnel, and the installed drainage pipe.
Figure 7:
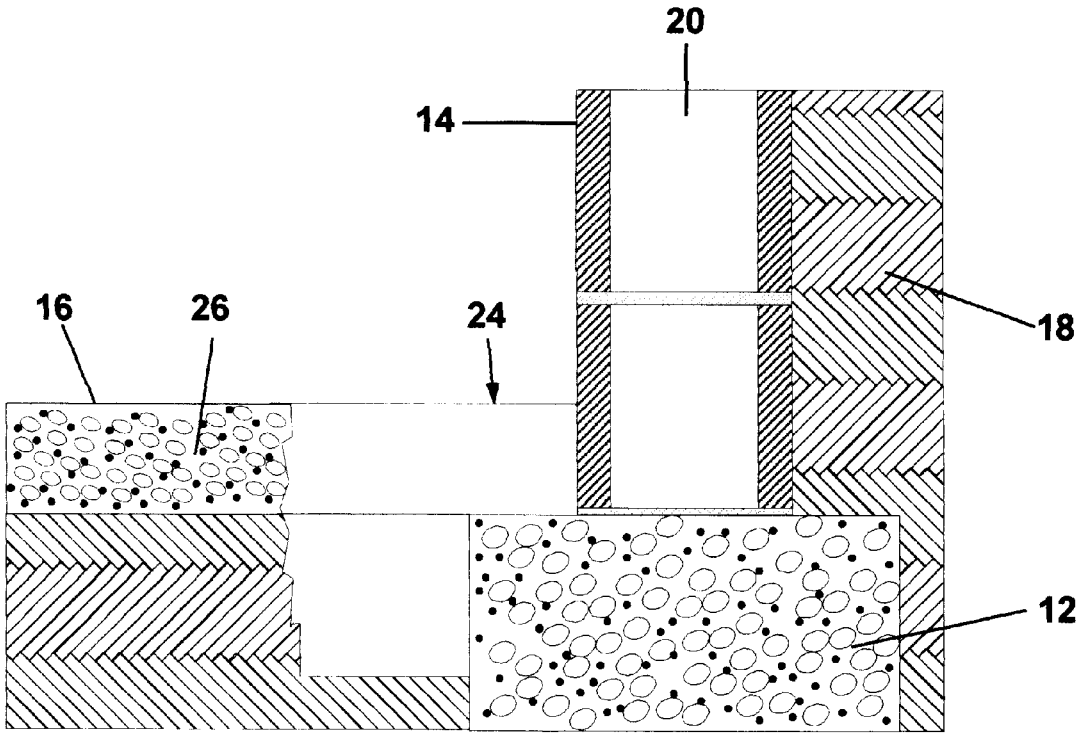
FIG. 7 is a cross-sectional view in side elevation taken along lines 7—7 in FIG. 1, showing an excavation area where a portion of the floor and the soil around the footing have been removed.

The first step of the waterproofing system of the invention comprises selecting a first area 24 of excavation of floor 16 through which a drainage pipe will be installed. As shown in FIG. 1, this first area 24 will typically be at one corner of the wall along the span of wall which is to be treated. Excavation may alternatively be made at an area 25 along the wall which is not at a corner as shown in FIG. 2. Its precise placement is not particularly critical, so long as it is adjacent to the footing of the wall. Whether additional areas of excavation to access a remote end of the installed drainage pipe will be needed will depend on the drainage field selected, as will be discussed in further detail below. Excavation area 24 is made to be sufficiently large to accommodate Appropriate excavation equipment, the types of which are well known to those skilled in the art. Hence, a small amount of concrete 26 from floor 16 is removed as shown in FIGS. 1 and 7. Excavation area 24 is dug to a sufficient depth and width to accommodate the lateral placement of a drainage pipe 30 beneath the level of the floor 16 and adjacent to footing 12. Area 24 is also excavated up to the wall 14. Once the sufficient depth is reached, lateral sub-floor excavation of a tunnel 28 is performed. Tunnel 28 may be extended to course around the internal perimeter of the structure as shown in FIG. 4, or it may just span along one wall section. Alternately, it may span across the room as shown in FIG. 4, or even pass outside the walls (not shown), depending upon the particular drainage field desired. After tunnel 28 is created, drainage pipe 30 is installed therein and placed along the length of the tunnel. As drainage pipe 30 must be bent through the excavation area to access tunnel 28, it is preferred that it be flexible. Alternately, rigid sections of pipe can be installed by inserting piece by piece. Various methods exist for installation of drainage pipe in this lateral fashion, and may not require that a second excavation area be created to pull the drainage pipe along through the tunnel. Some methods string along the drainage pipe simultaneously with drilling; such methods are known to those skilled in the art, and form no part of the invention per se. Thus, the installation of the drainage pipe below the floor is accomplished with the generation of a minimal amount of concrete debris, such debris constituting only that from the concrete 26 at the localized area 24, as opposed to the substantial amount of concrete debris which would be generated if the drainage pipe had been installed through and from above the entire span of floor along its length. Because the tunnel itself forms drainage means, it is also contemplated that the drainage pipe may be omitted and not installed. So long as the tunnel maintains its structural integrity and does not collapse, it can adequately itself serve as a drainage field.

Figure 9:
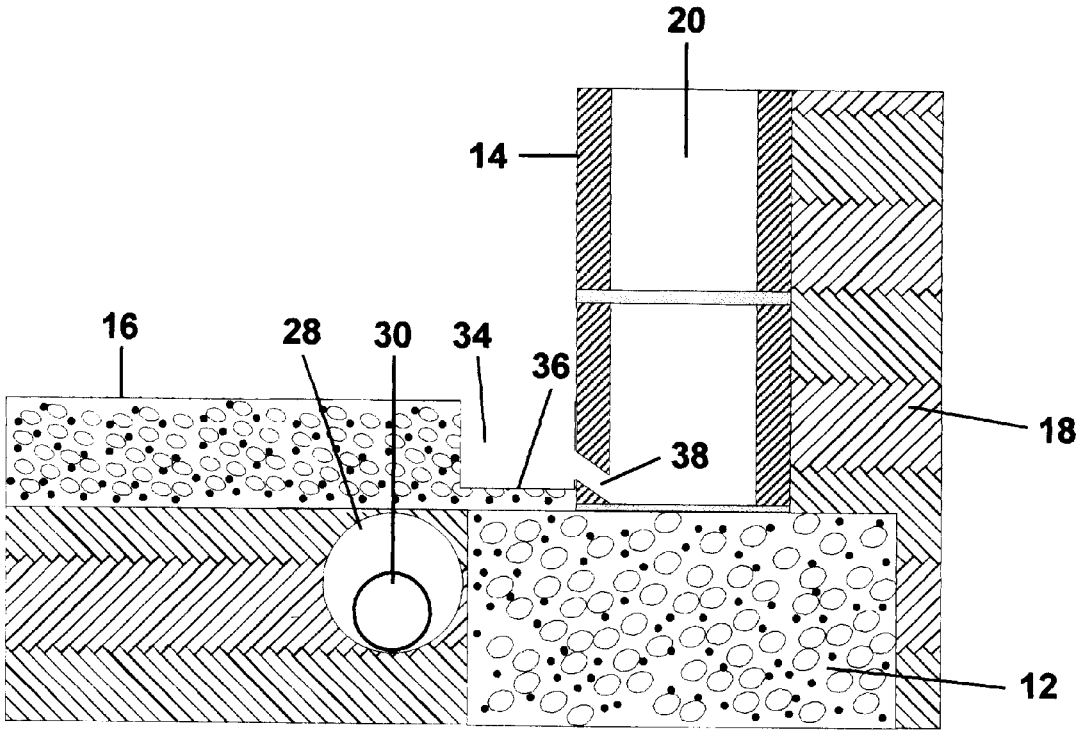
FIG. 9 is a cross-sectional view in side elevation taken along lines 9—9 of FIG. 4, showing the excavation of the channel along the wall.
Figure 10:
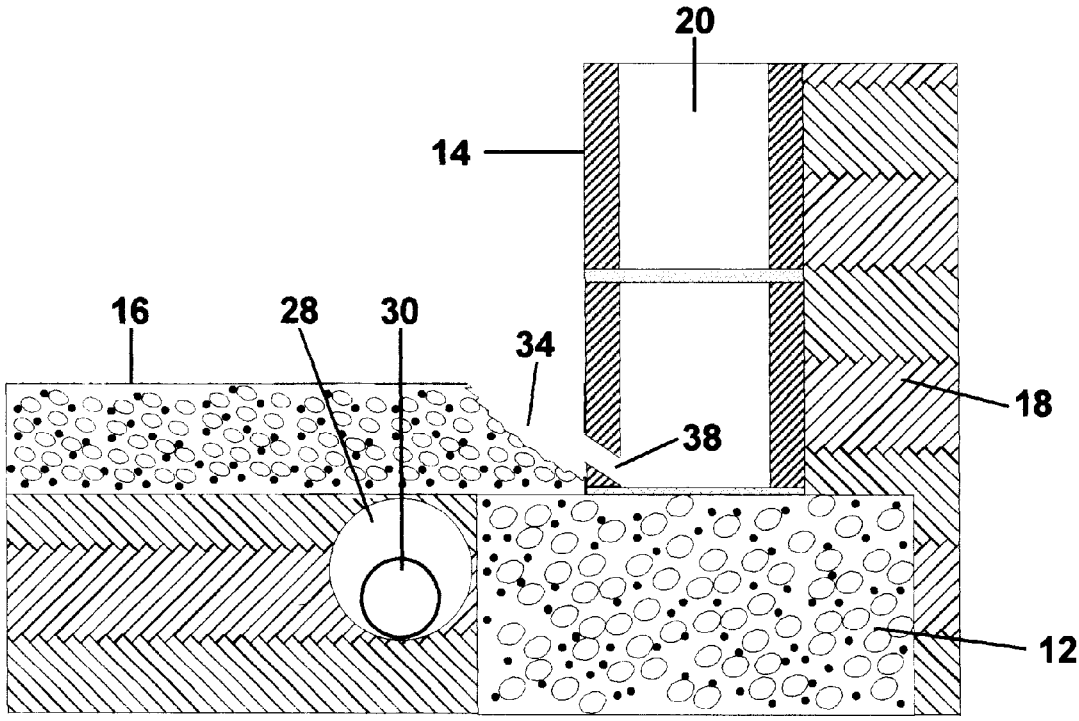
FIG. 10 is a cross-sectional view in side elevation similar to FIG. 9, showing an alternate method of excavation of the channel along the wall.
Figure 14:
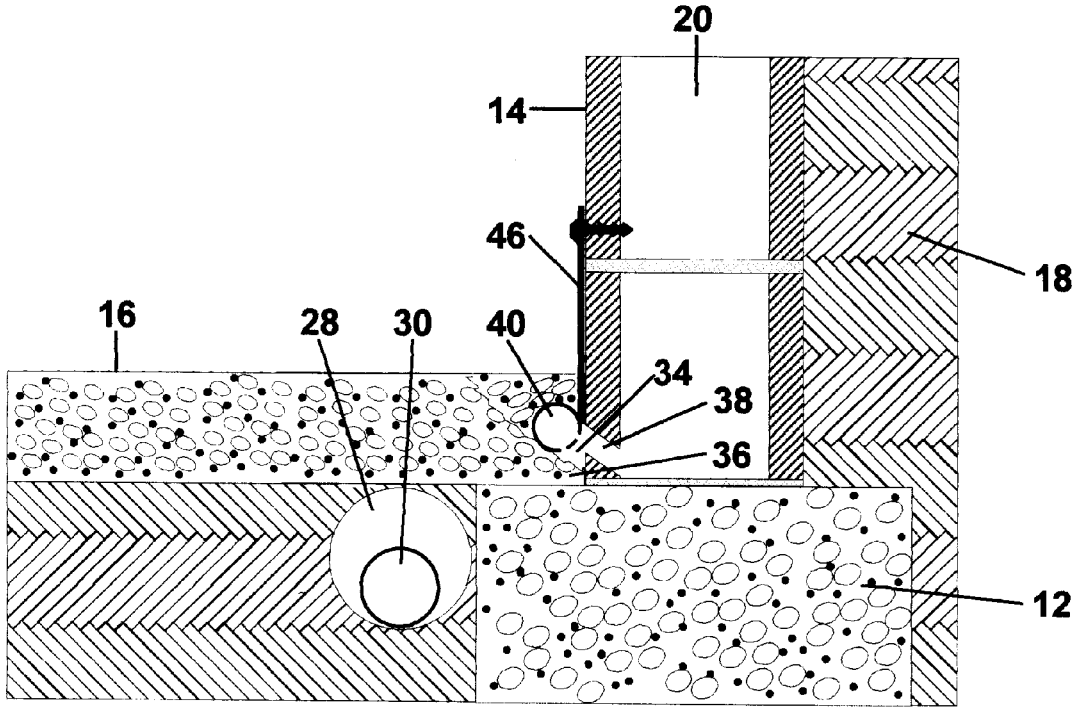
FIG. 14 is a view similar to FIG. 12 showing the placement of an auxiliary drainage pipe in the channel.

Once the drainage tunnel is formed, a channel 34 for capturing any accumulated moisture is created. Floor 16 is excavated to a short distance from wall 14 as shown in FIG. 9; preferably, a portion 36 of the floor is left intact to preserve structural strength to resist the lateral stress placed against the wall 14 by the exterior soil 18. The channel can be created by any appropriate method; FIG. 9 shows a rectilinear excavation which is accomplished by first cutting perpendicularly into the floor and then chipping away the portion between the cut and the wall. The cutting can be accomplished by using a diamond tip, for example. FIG. 10 shows the removal of the floor at an angle, which leaves more concrete in place to help withstand the lateral pressure from the outside soil. Where the wall has an interior chamber 20, weep holes 38 are drilled to facilitate drainage into channel 34 of any accumulated water from inside the wall. The weep holes are placed in the wall towards the bottom of the channel so that they are not blocked when the channel is sealed and covered. If desired, an auxiliary drainage pipe 40 comprising perforated PVC pipe or the like may be placed within channel 34 as shown in FIG. 14.

Figure 3:
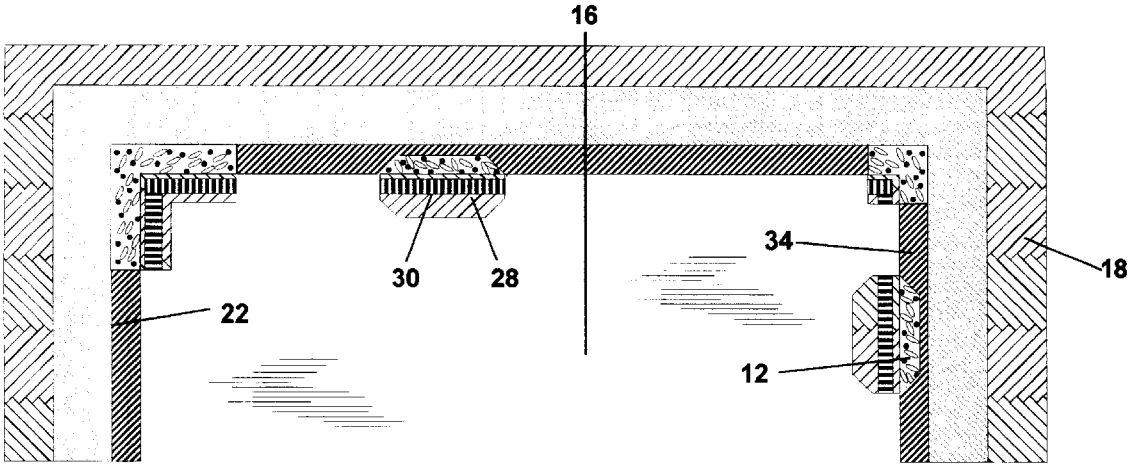
FIG. 3 is a cross-sectional top plan view of part of the floor, showing the excavation areas, the channel, and the installed drainage pipe.
Figure 8:
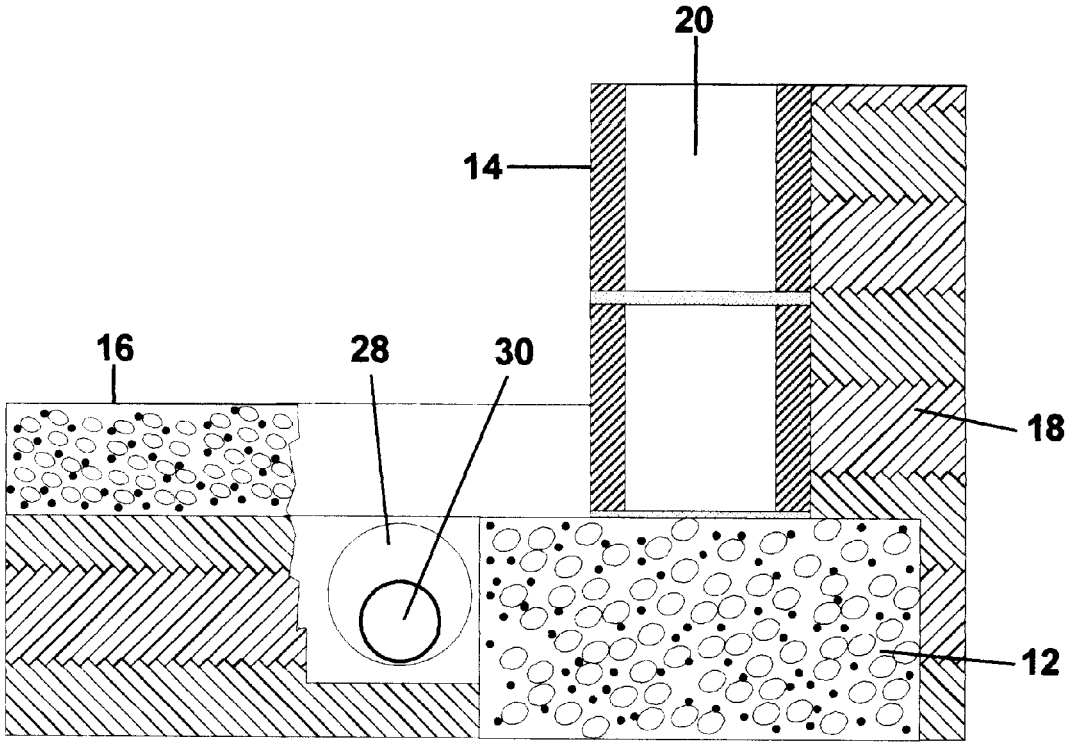
FIG. 8 is a cross-sectional view in side elevation taken along lines 8—8 of FIG. 4, showing the excavated tunnel and the installed drainage pipe.

Channel 34 is extended along the particular section of wall to be waterproofed, which in most cases will constitute the entire length of wall as shown in FIG. 3. Occasionally, however, it may only be necessary to extend the channel a limited distance along a section of wall. In any event, channel 34 must have at least one end in fluid communication with the first excavation area 24 as shown in FIG. 8 so that the channeled moisture can be drained into tunnel 28 and drainage pipe 30. As can be seen in FIGS. 9 and 10, channel 34 is not in fluid communication with the drainage pipe or tunnel at any point other than at the excavation areas. This is to minimize the amount of concrete that must be removed from the floor in creating the channel and also to preserve some of the structural integrity of the floor against the wall to withstand the lateral pressure from the outside soil.

Figure 11:
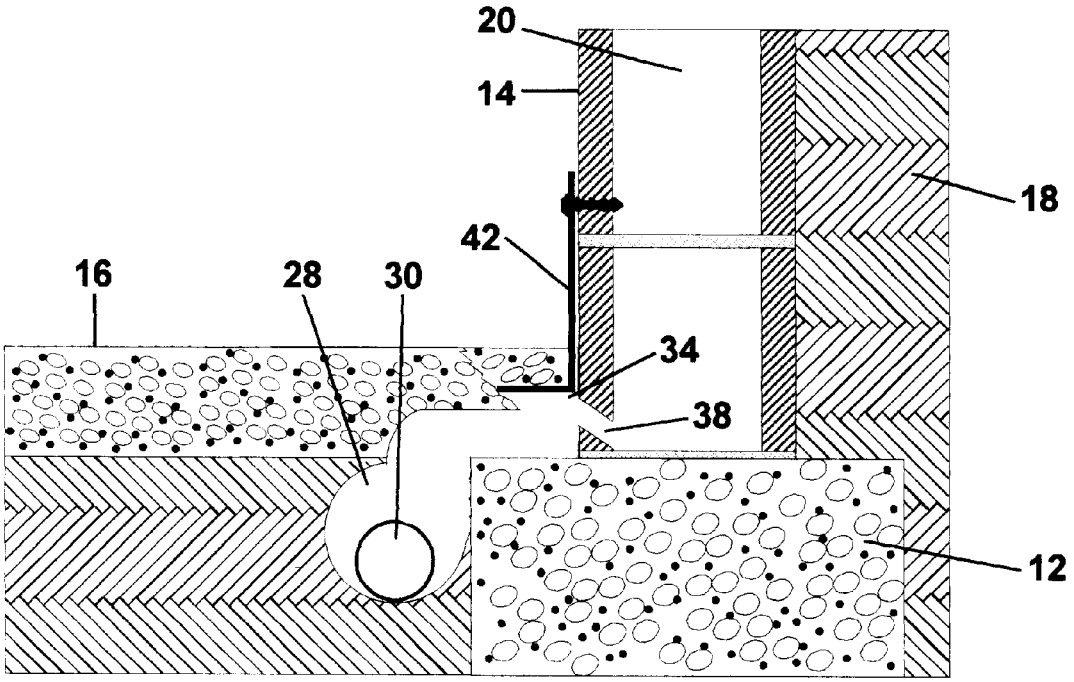
FIG. 11 is a cross-sectional view in side elevation taken along lines 11—11 of FIG. 4, showing the enclosed channel in communication with the excavation area.
Figure 12:
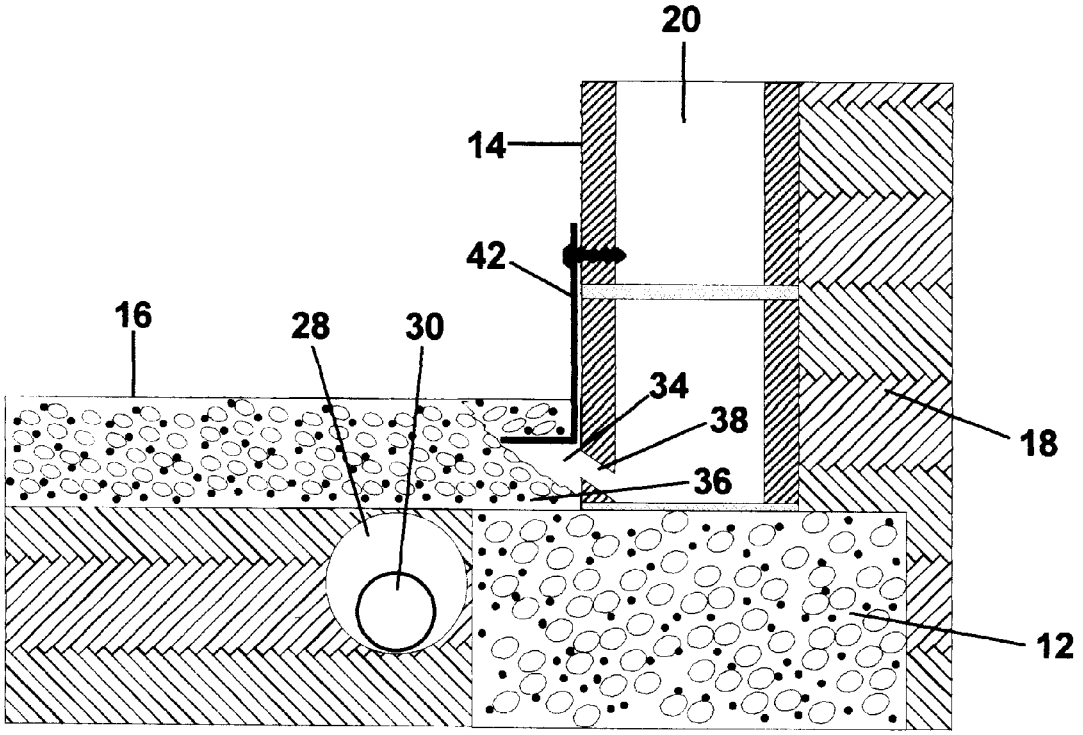
FIG. 12 is a cross-sectional view in side elevation taken along lines 12—12 of FIG. 4, showing the enclosed channel.
Figure 13:
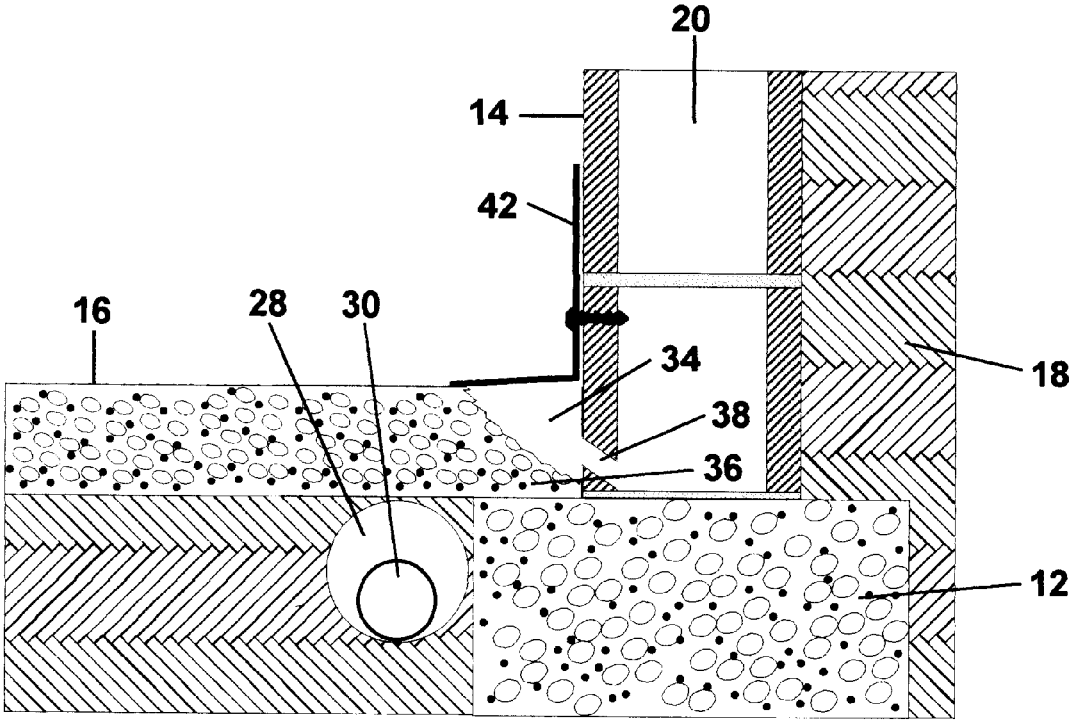
FIG. 13 is a view similar to FIG. 12 showing an alternate method of sealing the channel.
Figure 15:
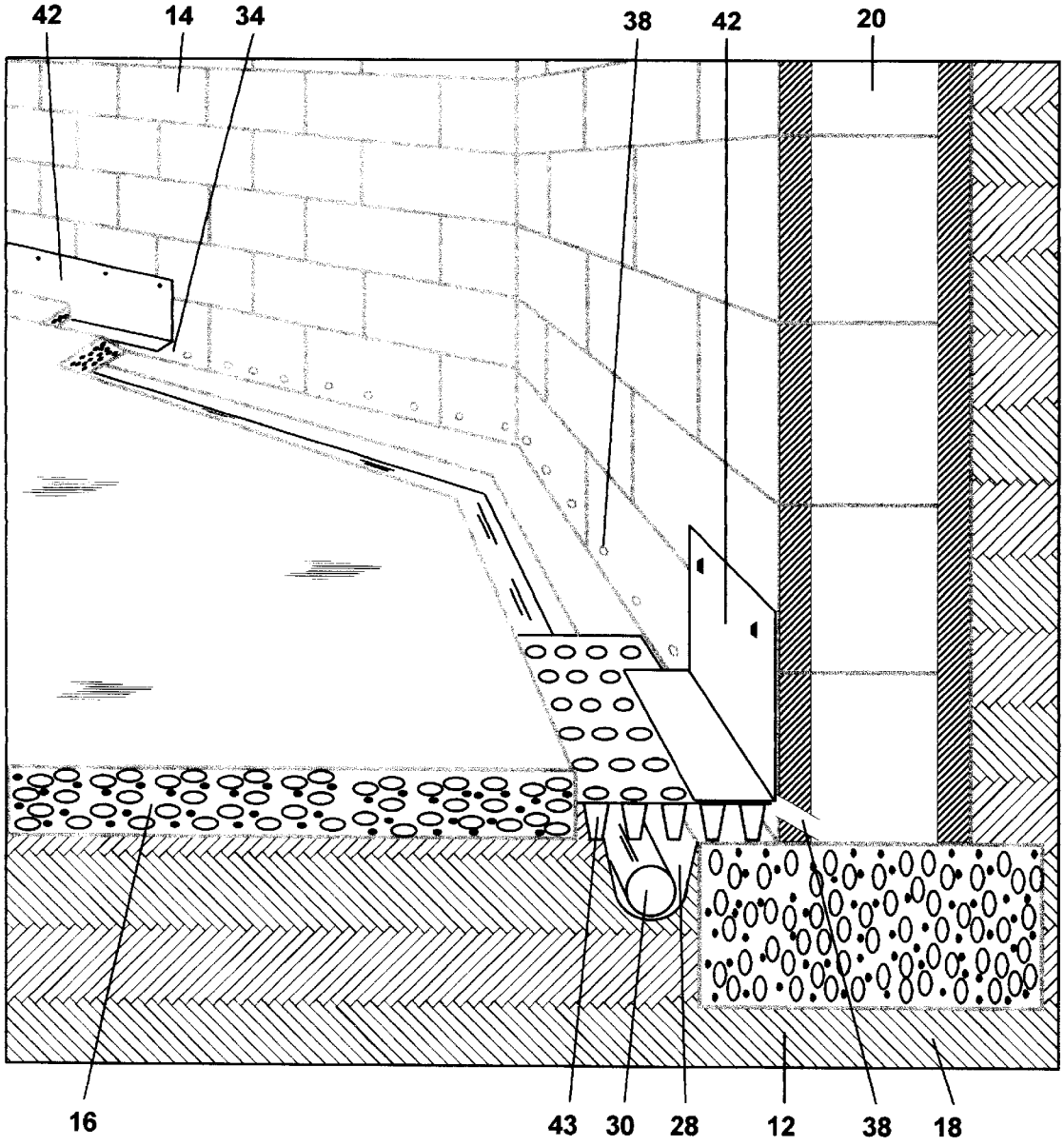
FIG. 15 is a perspective, partially cross-sectional view in side elevation, of an excavation area at a corner of a wall, showing the tunnel, drainage pipe and channel.

Once channel 34 is properly linked to excavation area 24, they are both sealed to form an interior closed passageway as shown in FIGS. 11 and 12. When sealing off the channel, it is important that moisture trickling down the side of the wall have a means to drain into the channel. Moisture may pass through the weep holes directly into the channel below the surface of the floor. There exist a number of methods known to those skilled in the art for sealing off the channel, for example, providing an L-shaped member 42 made of PVC or other appropriate material which provides both a seal against the wall and a seal over the channel as shown in FIGS. 13 and 15. Moisture is contained behind the L-shaped member and drains into the channel. A supportive drainage mat 43 can be placed underneath the L-shaped member. Alternately, the channel can be covered by laying down additional concrete over a drainage pipe as shown in FIG. 14. With that method a vertical seal member 46 is applied to the wall to direct the moisture down; seal above member 46, however, may terminate above weep hole 38 to permit drainage therethrough. Further, the excess concrete debris generated from the excavation can also be laid down in channel 34 (not shown). The broken pieces provide supporting structure for the floor surface, yet leave interstitial areas through which water may pass. The broken concrete pieces may also be spread out in tunnel 28.

While channel 34 must necessarily lie along the walls in order to effectively collect accumulated moisture, tunnel 28 may be disposed in virtually any orientation. It is only necessary that channel 34 be in fluid communication with an excavation area and tunnel 28 at one point for water to be drained off. Therefore, tunnel 28 may lie parallel with channel 34 and the wall, or may be disposed perpendicularly or transversely thereto as shown in FIG. 4. Tunnel 28 may even be extended to a drainage field outside the perimeter of the wall. Further, the excavation area can be selected at areas adjacent to the wall other than corners, such as in the middle 25 of the span of the wall. If desired, a second excavation area 44 can be provided at the end of the tunnel to facilitate installation of the drainage pipe 30. When such a second excavation area is created, channel 34 should be extended to it for drainage purposes.

Thus, the method of waterproofing a foundation provided by this invention enables a much greater efficiency in excavating of the floor for installation of the drainage pipe. The amount of concrete debris generated in installing the drainage pipe is limited to that from breaking up the floor at the area(s) of excavation and the channel. This results in less concrete required to be lifted and hauled off. Additionally, this method offers more flexibility in planning the layout of the tunnel and drainage pipe, in that the pipe need not be limited to lie parallel to the wall. For instance, if an obstruction blocked excavation of the tunnel adjacent to the wall, an alternate route could be selected that bypasses the obstruction, even one that would extend across the floor. However, it would not be necessary to excavate the entire floor along that path, as would be needed for other methods, because the tummel remains under the floor. It should be further understood that the method of this invention may be practiced by limiting it to the excavation of the tunnel itself. For instance, in situations where a retrofit to a pre-existing waterproofing job is required, the additional excavation of a channel at the juncture of the floor and wall may be unnecessary.

The waterproofing system of this invention, with the generation of decreased debris, has significant economic and environmental benefits. With this system, there is a great deal less of concrete to remove; the total amount may be only 15% of what would be generated by typical systems. Thus, there is less concrete that must be hauled off to landfills. Because the excavation of the tunnel only removes dirt, it is easy to keep the concrete separate from the removed dirt. As such, the removed dirt can be put to more useful purposes, such as selling as clean fill. The minimal removal of concrete is less labor intensive, creates less concrete dust, and provides minimal disruption to the floor. Also, since the floor is only opened to the underlying soil at limited areas, there is a drastic reduction in potential Radon emissions compared to all other systems where the entire floor around the drainage pipe is removed.

Various changes and modifications may be made within this invention as will be apparent to those skilled in the art. Such changes and modifications are within the scope and teaching of this invention as defined in the claims appended hereto.

What is claimed is:

1. A method for waterproofing a foundation in which a minimal amount of excavated debris is generated, said wall being supported on a footing, and a floor extending laterally from a bottom of said wall and said footing, said method comprising steps of:

a. selecting a position on said floor adjacent to said wall for a first area of excavation, b. excavating at said first area to a depth below said floor and adjacent to said footing, c. excavating a tunnel below said floor beginning at said first area of excavation and extending to a location remote from said first area of excavation, d. installing a drainage pipe through said tunnel, and e. excavating a channel within said floor along said wall to a depth below a top surface of said floor and to a width less than a diameter of said drainage pipe, f. directing said channel to lie in fluid communication with said first excavation area, whereby moisture leaking from said wall will enter said channel and flow to said first area of excavation and drain into said drainage pipe in said tunnel.

2. The method of claim 1 in which said tunnel is extended to lie parallel with said wall.

3. The method of claim 1 in which said tunnel is extended away from said wall.

4. The method of claim 2 in which a second excavation area is selected at said location remote from said first excavation area, said second excavation area being positioned to be in fluid communication with said channel, said second area being excavated to a depth to reach and be in fluid communication with said tunnel and said drainage pipe.

5. The method of claim 4 in which said first and second excavation areas are located at respective ends of said wall, said channel extending an entire length of said wall.

6. The method of claim 4 in which said first and second excavation areas are located at points intermediately spaced along said wall, said channel extending less than an entire length of said wall.

7. The method of claim 1 in which said wall is of the type having an inner chamber in which water can accumulate, weep holes being drilled into a bottom of said wall within said channel, whereby accumulated water within said wall is capable of draining into said channel.

8. The method of claim 1 in which a top opening of said channel and said excavation area are sealed after excavation is completed, leaving an interior closed passageway through which water may pass.

9. The method of claim 1 in which an auxiliary drainage pipe is placed within said channel.

10. The method of claim 1 in which said tunnel is extended to lie parallel with said wall, a second excavation area being selected at said location remote from said first excavation area, said second excavation area being positioned to be in fluid communication with said channel, said second area being excavated to a depth to reach and be in fluid communication with said tunnel and said drainage pipe, a top opening of said channel and said excavation area being sealed after excavation is completed, leaving an interior covered passageway through which water may pass.

11. The method of claim 1 in which said wall is of the type having an inner chamber in which water can accumulate, said tunnel being extended to lie parallel with said wall, a second excavation area being selected at said location remote from said first excavation area, said second excavation area being positioned to be in fluid communication with said channel, said second area being excavated to a depth to reach and be in fluid communication with said tunnel and said drainage pipe, weep holes being drilled into a bottom of said wall within said channel, whereby said accumulated water within said wall is capable of draining into said channel, a top opening of said channel and said excavation area being sealed flush with a surface of said floor after excavation is completed, leaving an interior covered passageway through which water may pass.

12. A method for waterproofing a room having a foundation in which a minimal amount of debris is generated, said wall being supported on a footing, with a floor extending laterally from a bottom of said wall and said footing, said wall comprising sections forming a perimeter around said floor such that corners are created, said method comprising steps of:

a. selecting a position on said floor at a first location adjacent to said wall for a first area of excavation, b. excavating at said first area to a depth below said floor and adjacent to said footing, c. excavating a tunnel below said floor beginning at said first area of excavation and extending to a location remote from said first area of excavation, d. selecting a second position on said floor adjacent to said wall at said remote location for a second area of excavation, e. excavating at said second area to a depth sufficient to reach and communicate with said tunnel, f. installing a drainage pipe through said tunnel, g. excavating a channel within said floor along said wall to a depth below a top surface of said floor and to a width less than a diameter of said drainage pipe, h. directing said channel to lie in fluid communication with said first and second excavation areas, whereby moisture leaking from said wall will enter said channel and flow to said first and second areas of excavation and drain into said drainage pipe in said tunnel.

13. The method of claim 12 in which said first and second areas of excavation are at adjacent corners of a section of said wall.

14. The method of claim 12 in which said first and second areas of excavation are at non-adjacent corners of said wall.

15. The method of claim 12 in which said first and second areas of excavation both lie along a single section of said wall.

16. The method of claim 12 in which said first and second areas of excavation respectively lie along adjacent sections of said wall, said channel being extended around a corner lying between said adjacent sections of said wall.

17. The method of claim 12 in which said first and second areas of excavation respectively lie along opposite sections of said wall, said channel being extended around corners lying between said opposite sections of said wall.

18. The method of claim 12 in which said wall is of the type having an inner chamber in which water can accumulate, weep holes being drilled into a bottom of said wall within said channel, whereby accumulated water within said wall is capable of draining into said channel.

19. The method of claim 12 in which top openings of said channel and said excavation areas are sealed after excavation is completed, leaving an interior closed passageway through which water may pass.

20. The method of claim 12 in which said wall is of the type having an inner chamber in which water can accumulate, weep holes being drilled into a bottom of said wall within said channel, whereby accumulated water within said wall is capable of draining into said channel, top openings of said channel and said excavation areas being sealed after excavation is completed, leaving an interior closed passageway through which water may pass.

21. The method of claim 12 in which an auxiliary drainage pipe is placed within said channel.

22. A method for waterproofing a foundation in which a minimal amount of excavated debris is generated, said wall being supported on a footing, and a floor extending laterally from a bottom of said wall and said footing, said method comprising steps of:

a. selecting a position on said floor adjacent to said wall for a first area of excavation, b. excavating at said first area to a depth below said floor and adjacent to said footing, c. excavating a tunnel below said floor beginning at said first area of excavation and extending to a location remote from said first area of excavation, d. excavating a channel within said floor adjacent to and along said wall to a depth below a top surface of said floor, e. directing said channel to lie in fluid communication with said first excavation area, whereby moisture leaking from said wall will enter said channel and flow to said first area of excavation and drain into said tunnel.

23. The method of claim 19 in which said tunnel lies parallel with said wall.

24. The method of claim 19 in which said tunnel extends away from said wall.

25. The method of claim 19 in which a second excavation area is selected at said location remote from said first excavation area, said second excavation area being positioned to be in fluid communication with said channel, said second area being excavated to a depth to reach and be in fluid communication with said tunnel.

26. The method of claim 25 in which said first and second excavation areas are located at respective ends of said wall, said channel extending an entire length of said wall.

27. The method of claim 19 in which said wall is of the type having an inner chamber in which water can accumulate, weep holes being drilled into a bottom of said wall within said channel, whereby accumulated water within said wall is capable of draining into said channel.

28. The method of claim 19 in which a top opening of said a channel and said excavation area are sealed after excavation is completed, leaving an interior closed passage way through which water may pass.

29. A method for waterproofing a foundation in which a minimal amount of excavated debris is generated, said wall being supported on a footing, and a floor extending laterally from a bottom of said wall, said method comprising steps of:

a. selecting a position on said floor adjacent to said wall for a first area of excavation, b. excavating at said first area to a depth below said floor and adjacent to said footing, c. excavating a tunnel below said floor beginning at said first area of excavation and extending to a location remote from said first area of excavation, whereby moisture leaking from said wall will enter said first area of excavation and drain into said tunnel.

30. The method of claim 29 in which a drainage pipe is placed within said tunnel.

* * * * *